US007225056B2

(12) United States Patent
Bolduan et al.

(10) Patent No.: US 7,225,056 B2
(45) Date of Patent: May 29, 2007

(54) METHOD FOR CHECKING VALVES IN A PROGRAM-CONTROLLED WATER-CARRYING HOUSEHOLD APPLIANCE

(75) Inventors: Edwin Bolduan, Berlin (DE); Horst Wiemer, Kleinmachnow (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/926,930

(22) Filed: Aug. 26, 2004

(65) Prior Publication Data

US 2005/0049756 A1 Mar. 3, 2005

(30) Foreign Application Priority Data

Aug. 26, 2003 (DE) ..... 103 39 252

(51) Int. Cl.
*G05D 7/00* (2006.01)

(52) U.S. Cl. ..... 700/282; 700/281; 137/15.11; 73/40

(58) Field of Classification Search ..... 700/281, 700/282, 283, 79, 80; 137/1, 12, 486, 487.5, 137/15.11; 340/603, 605, 606, 608; 73/1.17, 73/40, 592

See application file for complete search history.

(56) References Cited

U.S. PATENT DOCUMENTS 5,441,070 A * 8/1995 Thompson ..... 137/1
5,568,825 A * 10/1996 Faulk ..... 137/486
6,119,720 A * 9/2000 Isaacson et al. ..... 137/459
6,317,051 B1 * 11/2001 Cohen ..... 340/603
6,691,724 B2 * 2/2004 Ford ..... 137/1
6,778,868 B2 * 8/2004 Imamura et al. ..... 700/79
2002/0032491 A1 * 3/2002 Imamura et al. ..... 700/79

FOREIGN PATENT DOCUMENTS

DE 39 00 705 A1 7/1990
DE 39 17 013 C2 11/1990

* cited by examiner

*Primary Examiner*—Leo Picard
*Assistant Examiner*—Charles Kasenge
(74) *Attorney, Agent, or Firm*—Russell W. Wamock; Craig J. Loest

(57) ABSTRACT

In household appliances with a safety hose, the stop valve and the control valve are hydraulically connected in series. It is thus impossible, or very difficult, for the user to detect when one of the valves is operating erroneously and not closing completely. The functioning of the control valve and of the stop valve is checked each time the household appliance is used. For this purpose, the valves and are alternately opened and closed in a selected phase during operation, or are opened and closed one after the other. The change over time in the measured values is recorded and evaluated in a suitable manner at a pressure sensor and/or at a throughflow meter. On account of the multiple use of the measuring sensors that are present, the cost of implementing the method is restricted to expanding the control system software.

18 Claims, 2 Drawing Sheets

METHOD FOR CHECKING VALVES IN A PROGRAM-CONTROLLED WATER-CARRYING HOUSEHOLD APPLIANCE

BACKGROUND OF THE INVENTION

Field of the Invention

The invention is based on a method for checking valves in a program-controlled water-carrying household appliance, in particular in a washing machine or a washer dryer. The machine may be equipped with a control valve that controls the supply of water, with a measuring device that detects the water feed, and with a safety inflow system that contains a stop valve for stopping the supply of water in the event of a problem caused by leakage water.

A safety device of that type has become known from German patent DE 39 17 013 C2. The safety hose for a hydraulically secured connection of water-carrying household appliances described in that document has a solenoid valve for blocking off the supply of water in the event of leak, which solenoid valve is accommodated in a valve armature which is directly connected to the domestic water mains. The safety hose is the connection between the household appliance and the domestic water mains. Water is fed by means of a delivery hose and is controlled by the control valve, which is disposed in the appliance directly downstream of the hose connection. The delivery hose is surrounded at an axial distance by a flexible outer tube, which collects escaping leakage water and diverts it into the household appliance. The shut-off valve at the domestic water mains is closed by a switching signal, which is triggered in the event of a leak by a monitoring device in the household appliance.

Household appliances in which the water flowing in is to be distributed further contain at least one control valve. In the case of household appliances of this type which have a safety hose, the stop valve and the control valve are hydraulically connected in series. This type of system is redundant in terms of safety: Both valves are closed before the program starts and once the program has finished. This type of arrangement and of this connection means that leaks at one of the two valves are very difficult to detect. Problems at the stop valve, for example due to lime deposits during long-term operation of the appliance or due to faults in the control line, have no effect at all if the control valve is operating without problems. The user receives no information as to whether the stop valve is closing, that is to say whether the valve is performing its intended role as an emergency shut-off switch in the rare case that leakage water escapes, thereby being able to prevent greater damage to the appliance and to the area in which it is installed.

The stop valve which is part of the safety system is opened at the start of the program and remains in the open position for the entire program run time. A leaking stop valve has no effect on the program sequence of the household appliance and can therefore not be detected in this phase either. The inflow of water as required by the program during the working cycle is controlled exclusively by the control valve in accordance with the parameters predefined for the program section in question. Pressure sensors which record the filling level in the appliance are mostly used for this purpose. The filling level is also used to regulate the inflow of water by a signal for closing the control valve arranged in the inflow line being generated when a predefined upper setpoint level is reached and by the control valve being opened again when the water level falls below a lower setpoint level.

The method controlled in this way can be improved upon in accordance with German patent DE 39 00 705 C1 if the inflow of water is observed using an idealized inflow curve which is matched to the type of machine. The filling process is relatively slow in this improved method too, and has the further disadvantage that the amount of water flowing in cannot be limited narrowly enough and as a result more water than is absolutely necessary for the washing process regularly flows in. In order to be able to restrict the amount of water supplied for each program section to the necessary minimum, the amount of water flowing in must be determined independently of the fluctuating pressure conditions in the domestic water mains as accurately as possible and must be able to be limited with as narrow a tolerance as possible. For this purpose, and in order to speed up the filling process, throughflow meters are increasingly being used.

SUMMARY OF THE INVENTION

It is accordingly an object of the invention to provide a method of checking a valve in a program-controlled, water-carrying household appliance which overcomes the above-mentioned disadvantages of the heretofore-known devices and methods of this general type and which improves the reliability of the inflow system described above. In the process, the expenditure of implementing the method is to be restricted to a minimum, in particular there must be no need to use additional assemblies or individual parts.

With the foregoing and other objects in view there is provided, in accordance with the invention, a method for checking the valves of a program-controlled water-carrying household appliance, such as a washing machine or a washer dryer. The method is to be carried out in a household appliance equipped with a control valve controlling a supply of water, with a measuring device detecting a water feed, and with a safety inflow system including a stop valve for stopping the supply of water in an event of a problem caused by leakage water. The method comprises checking the functionality (i.e., serviceability) of the control valve and of the stop valve each time the household appliance is used at least once during a time selected from the group consisting of before, after, and during a course of program processing.

In other words, the objects of the invention are achieved by checking the functioning of the control valve and of the stop valve before, after, and/or during the course of a program each time the household appliance is put into use. As indicators of the functional reliability of the valves, measured data which can be obtained by means of the devices available for monitoring the amount of water flowing in are evaluated, for example by means of the pressure sensor used to monitor the filling level or by means of the throughflow meter. This expansion of the functions of the available measured value sensors, the pressure sensor or the throughflow meter means that expenditure on implementing the method is restricted to expanding the control system software.

In accordance with an added feature of the invention, the valves are alternately opened and closed for checking the functioning and a certain change in the measured values of a measuring device which detects the water feed serves to identify a problem at a valve.

In accordance with an additional feature of the invention, during a predetermined water inflow phase, measured values are continuously picked up by the measuring device which detects the water feed or are picked up at brief, specifically predefined intervals, and in that the control valve and the stop valve are closed one after the other for a brief period of time, and the change in the measured values is compared with a setpoint value stored in memory by an intelligent evaluation system.

In accordance with a further feature of the invention, the period of time is extended by one unit of time once or more than once until the measured values relating to the closing time have reached an experimentally determined stipulated value.

In accordance with a further feature of the invention, a warning signal and/or an error message are/is output when the intelligent evaluation system detects a significant problem.

With the above and other objects in view there is also provided, in accordance with the invention, a device that is configured to carry out the novel method and which has a pressure sensor or a throughflow meter forming the above-noted measuring device that detects the water feed.

Other features which are considered as characteristic for the invention are set forth in the appended claims.

Although the invention is illustrated and described herein as embodied in a method for checking valves in a program-controlled water-carrying household appliance, it is nevertheless not intended to be limited to the details shown, since various modifications and structural changes may be made therein without departing from the spirit of the invention and within the scope and range of equivalents of the claims.

As noted above, the invention is particularly suitable for a washing machine (i.e., a washer) and for a washer dryer (i.e., a combined washing and drying machine, or a washer with a drying cycle). Other appliances are within the field of the invention.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
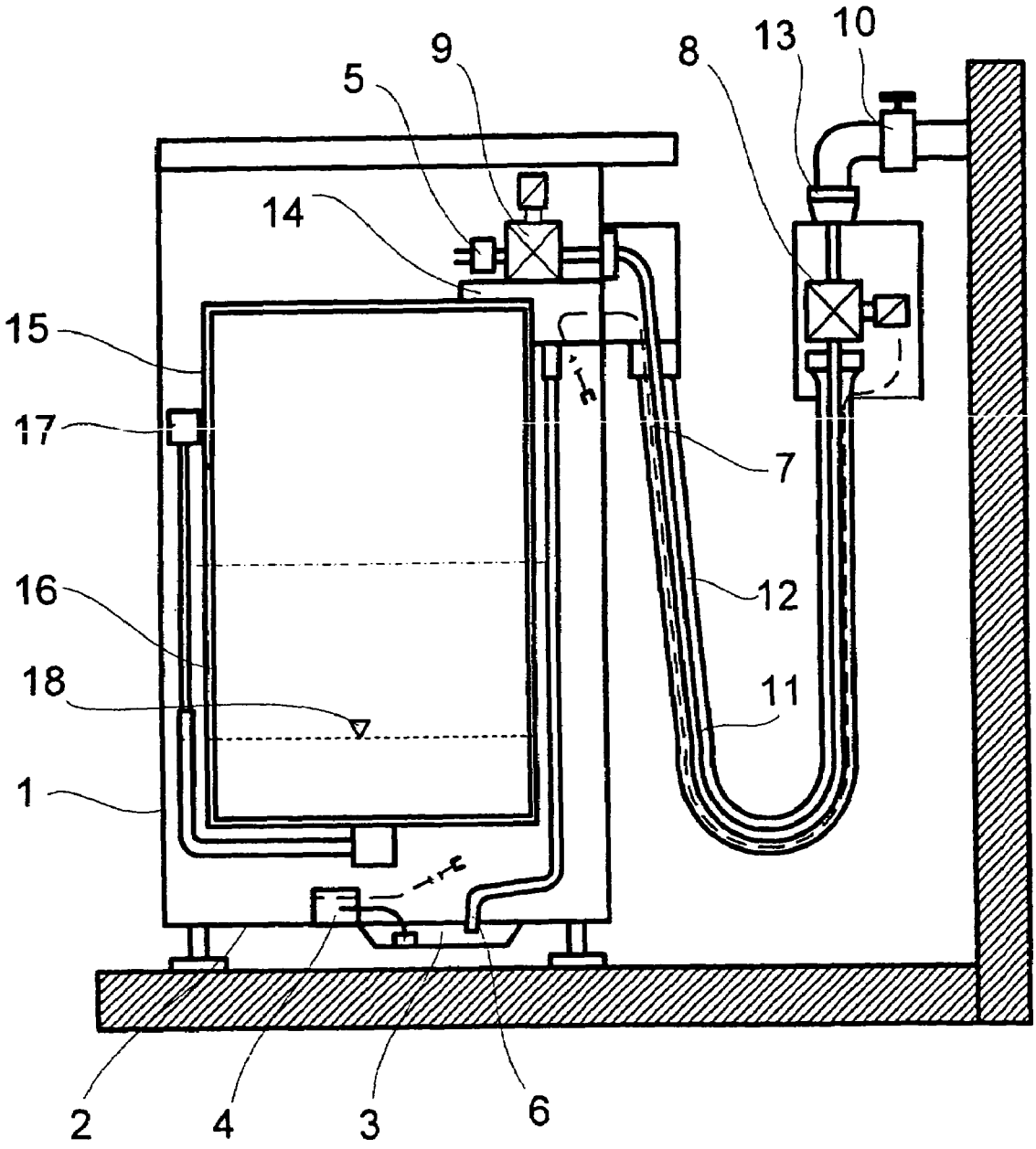
FIG. 1 is a partly transparent side view of a washing machine having a safety hose.

Referring now to the figures of the drawing in detail and first, particularly, to FIG. 1 thereof, there is shown a schematic view of a washing machine with a safety hose 11, 12 for leakage water that is securely connected to the water mains connection 10 by way of the screwed connection 13. In the event of a problem as a result of leakage water escaping, a corresponding closing signal is supplied to the stop valve 8 arranged directly downstream of the water mains connection 10 in order to allow the stop valve to shut off the inflow of water. This closing signal is triggered by the monitoring device 4 and conducted to the stop valve 8 via the signal line 7 which runs between the delivery hose 11 and the flexible outer tube 12. The monitoring device 4 is arranged in the trough 3 which is formed in the base plate 2 of the washing machine housing 1 and in which the leakage water is collected.

The washing tub 15 and the washing drum 16 rotatably mounted therein are filled with water from the mains connection 10 via the stop valve 8, the delivery hose 11, the control valve 9 and the throughflow meter 5, this filling being controlled by a control device which has not been illustrated.

Control valves 9 are needed in washing machines on account of the required distribution to a plurality of chambers of a non-illustrated detergent feed device. These and further components and lines connected downstream and via which the water flows into the washing tub 15 are of no importance to the understanding of the method according to the invention and they are therefore likewise not illustrated.

The inflow of water is regulated by means of the control valve 9 as a function of the water level 18 in the washing tub 15 by the pressure sensor 17 and/or as a function of the amount of water flowing in by the throughflow meter 5.

Before the appliance is used, the control valve 9 and the stop valve 8 are closed. The stop valve 8 is opened each time a program starts and remains in the open position until the program has finished. The control valve 9 is only opened during the controlled inlet of water.

In a first variant for implementing the method according to the invention, it is provided in order to check the functioning of the valves 8 and 9 hydraulically connected in series that the valves are alternately opened and closed before, after or during the course of the program in a phase in which the drum 16 in the washing tub 15 is not moved and the control valve 9 is shut off in accordance with program requirements, and the change in the level of water in the washing tub is recorded by the pressure sensor 18. Given switching times selected to be suitably long, the faulty valve 9 or 8 can be identified by comparison with a setpoint value stored in memory and experimentally determined for each type of appliance separately.

For example, when valve 9 is initially moved to the closed position, the valve 8 is first moved to the closed position for a short time and even when valve 8 is in the closed position, the valve 9 is moved to the open position for a short time. If, in this case, the level of washing solution in the washing tub 15 changes significantly, then the valve 8 is faulty since it should have been closed in accordance with a corresponding control signal. In a further checking phase, the valve 8 may be moved to the open position for a short time and even when valve 8 is in the open position, the valve 9 may be moved to the closed position for a short time. If, when the valve 8 is in the open position, the level of washing solution likewise changes significantly, the valve 9 is faulty because it should have been closed in accordance with a closing signal which is present.

In a preferred second variant of the invention, the measured values are evaluated at the throughflow meter 5 in the above-described method. Recording the measured values using the throughflow meter 5 ensures a significant improvement in accuracy and therefore a greater reliability in using the method according to the invention to ensure the reliable diagnosis of a valve 8 or 9 which is not closing or is not closing completely, even in the case of short closing times. Since the measured values are not corrupted by drum movement, the method can also be carried out during a washing or rinsing phase.

Figure 2:
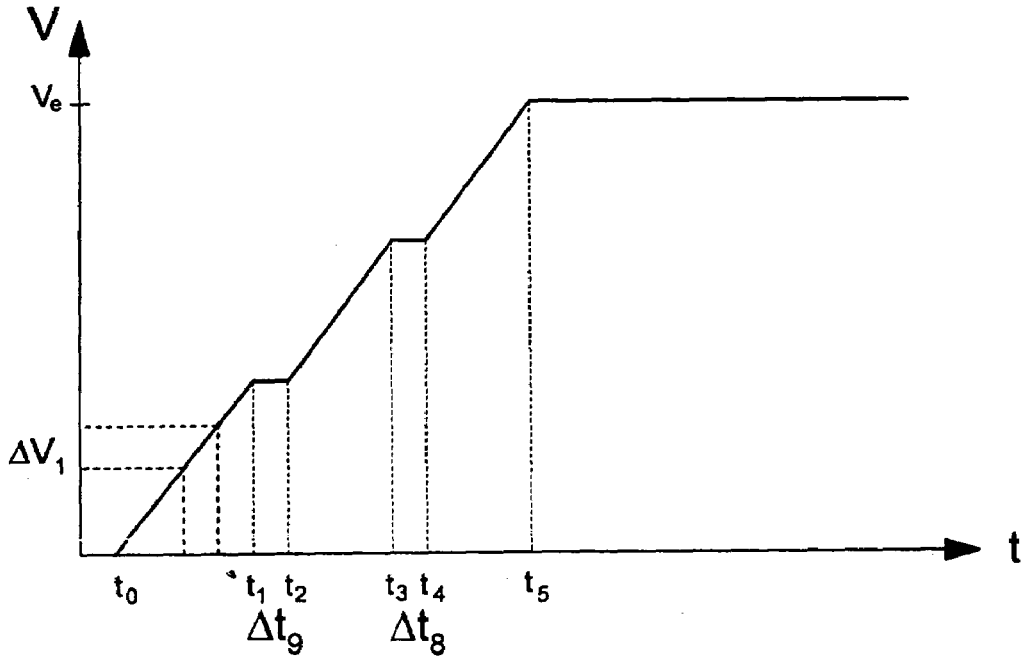
FIG. 2 is a volume/time diagram for a first example of a filling process with the valves being checked.

A further preferred variant for carrying out the method according to the invention will be described with reference to the diagrams shown in FIGS. 2 and 3. The diagrams show the profile of the volume flow over time when filling the washing tub of a washing machine under different pressure conditions at the mains connection. In the diagram, $V_e$ is the total volume of water to be introduced for the program segment and $\Delta V_1$ is the amount of water flowing in over a specific time. The water pressure is assumed to be constant during the inflow phase.

In a departure from the above examples, the control valve 9 and the stop valve 8 are closed one after the other for a short period of time $\Delta t_9$ and $\Delta t_8$ respectively, during a selected water inflow phase and the change in the measured values preferably recorded at the throughflow meter 5 is compared with a setpoint value stored in memory by an intelligent evaluation system. The closing time $\Delta t$ for the valves 8 and 9 is to be dimensioned such that, with a normal water pressure in the supply mains, the drop in the flow of water can be reliably recorded in the throughflow meter. On the other hand, the filling of the washing tub should only be interrupted for as short a time as possible, that is to say the closing time $\Delta t$ should be so tightly dimensioned that the overall program run time is not significantly extended. These conditions can be satisfied with closing times in the range of one second and with the use of a throughflow meter forming the measured value sensor. In addition to significantly higher sensitivity, it is advantageous to use the throughflow meter in order to be able to carry out the method in phases with the washing drum moving too, as in the second variant described.

In order to preclude erroneous diagnoses, a further refinement of the method according to the invention provides for the system to be self-calibrated. For this purpose, the closing time $\Delta t$ is adapted by automatic control to the boundary conditions, for example to the water pressure in the domestic water mains, prevailing at the time of the function check. In the case of the expanded method, the volume flow $\Delta V$ over the period of time $\Delta t$ is measured first in the selected water inflow phase. This $\Delta V$ must not fall below a minimum value which is experimentally determined for each model of washing machine and is permanently stored in the program memory as a setpoint value. If $\Delta V/\Delta t$ is below the setpoint value, the closing time $\Delta t$ is extended in steps by one unit of time and the process is repeated.

Figure 3:
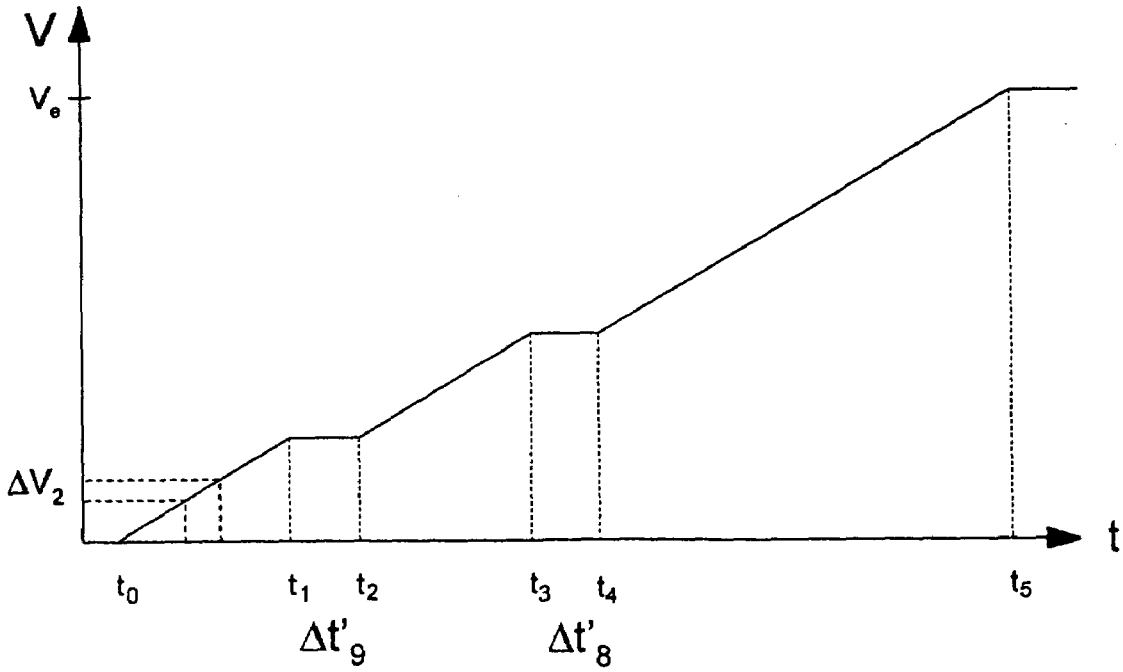
FIG. 3 is a volume/time diagram for a second example of a filling process with the valves being checked.

The method sequence is to be explained with the aid of the diagram in FIG. 3. In this example, the water flows in considerably more slowly, as can be seen by the flat profile of the inlet curve. The cause of this may be a drop in pressure on account of an increased amount of water being taken from the domestic water mains or on account of a partial interruption in the feed of water from the domestic water mains.

The volume of water flowing in per unit time $\Delta t$ can be read off from the abscissa at $\Delta V_2$. $\Delta V_2/\Delta t$ is considerably lower than $\Delta V_1/\Delta t$ in FIG. 2 and in the example should be below the predefined setpoint value. It is provided in this case, that the process is once again repeated under the automatic control of the system. The closing time $\Delta t$ is extended by one unit of time with each repetition. In the example, it is assumed that the setpoint value is reached or exceeded after a time extension and the calibration process is thereby concluded. The $\Delta t'$ value determined in this way is then the new closing time for the control valve 9 ($\Delta t'_9 = t_2 - t_1$) and for the stop valve 8 ($\Delta t'_8 = t_4 - t_3$).

This type of calibration virtually precludes the possibility of erroneous diagnoses by the system and thus of the unjustifiable triggering of error messages. The functional reliability of the method is not restricted by temporary problems with the inflow of water or with the supply mains or by insufficient sensitivity of the throughflow meter. The reliability of the method can be further improved by the fact that a problem which has been diagnosed is checked once again at a later point in time under the control of the system.

This application claims the priority, under 35 U.S.C. § 119, of German patent application No. 103 39 252.1, filed Aug. 26, 2003; the entire disclosure of the prior application is herewith incorporated by reference.

We claim:

1. In a program-controlled water-carrying household appliance equipped with a control valve controlling a supply of water, with a measuring device detecting a water feed, and with a safety inflow system including a stop valve for stopping the supply of water in an event of a problem caused by leakage water, a method for checking the valves of the household appliance, the method which comprises:

checking a functionality of the control valve and of the stop valve each time the household appliance is used at least once during a time selected from the group consisting of before, after, and during a course of program processing; and alternately opening and closing the valves for checking the functionality and utilizing a certain change in the measured values of the measuring device for detecting the water feed to identify a problem at a valve.

2. The method according to claim 1, which comprises, during a predetermined water inflow phase, continuously picking up measured values with the measuring device detecting the water feed, closing the control valve and the stop valve one after the other for a pre-determined period of time, and comparing a change in the measured values with a setpoint value stored in memory with evaluation system.

3. The method according to claim 2, which comprises extending the period of time by one unit of time once or more than once until the measured values relating to the closing time have reached an experimentally determined stipulated value.

4. The method according to claim 2, which comprises issuing at least one of a warning signal and an error message when the evaluation system detects a significant problem.

5. The method according to claim 1 configured for checking the valves of a washing machine.

6. The method according to claim 1 configured for checking the valves of a washer dryer.

7. In a program-controlled water-carrying household appliance equipped with a control valve controlling a supply of water, with a measuring device detecting a water feed, and with a safety inflow system including a stop valve for stopping the supply of water in an event of a problem caused by leakage water, a method for checking the valves of the household appliance, the method which comprises:

checking a functionality of the control valve and of the stop valve each time the household appliance is used at least once during a time selected from the group consisting of before, after, and during a course of program processing;

during a predetermined water inflow phase, continuously picking up measured values with the measuring device detecting the water feed, closing the control valve and the stop valve one after the other for a pre-determined period of time, and comparing a change in the measured values with a setpoint value stored in memory with evaluation system;

setting the pre-determined period of time within a range of approximately one to five seconds.

8. The method according to claim 1, which comprises, during a predetermined water inflow phase, picking up measured values with the measuring device detecting the water feed at brief, specifically predefined intervals, closing the control valve and the stop valve one after the other for a pre-determined period of time, and comparing a change in the measured values with a setpoint value stored in memory with evaluation system.

9. The method according to claim 8, which comprises extending the period of time by one unit of time once or more than once until the measured values relating to the closing time have reached an experimentally determined stipulated value.

10. In a program-controlled water-carrying household appliance equipped with a control valve controlling a supply of water, with a measuring device detecting a water feed, and with a safety inflow system including a stop valve for stopping the supply of water in an event of a problem caused by leakage water, a method for checking the valves of the household appliance, the method which comprises:

checking a functionality of the control valve and of the stop valve each time the household appliance is used at least once during a time selected from the group consisting of before, after, and during a course of program processing;

during a predetermined water inflow phase, picking up measured values with the measuring device detecting the water feed at brief, specifically predefined intervals, closing the control valve and the stop valve one after the other for a pre-determined period of time, and comparing a change in the measured values with a setpoint value stored in memory with evaluation system; and setting the pre-determined period of time within a range of approximately one to five seconds.

11. A method for checking the functionality of valves in a program-controlled water-carrying household appliance including a conduit having a first end connected to a water connection providing water to the appliance and a second end connected to the housing, a stop valve disposed near the first end controlling water flow from the water connection to the conduit, a control valve disposed near the second end controlling water flow from the conduit to the tub, a sensor disposed downstream from the control valve, and a control device controlling operation of the stop valve and control valve and receiving signals from the sensor, the method comprising the acts of:

opening at least one of the stop valve and the control valve;

closing the other of the stop valve and the control valve;

sensing a water flow with the sensor and providing a signal to the control device;

alternately opening and closing the stop and control valves for multiple cycles while sensing the water flow with the sensor; and determining if the stop and control valves are functioning properly in response to the signal from the sensor and the condition of the stop and control valves.

12. The method according to claim 11, wherein the act of opening includes opening the stop valve and the act of closing includes closing the control valve.

13. The method according to claim 11, wherein the act of opening includes opening the control valve and the act of closing includes closing the stop valve.

14. The method according to claim 11, wherein the stop and control valves are each closed for about one second for each cycle.

15. A program-controlled water-carrying household appliance comprising:

a housing;

a tub for retaining water disposed within the housing;

a conduit having a first end connected to a water connection providing water to the appliance and a second end connected to the housing;

a stop valve disposed near the first end controlling water flow from the water connection to the conduit;

a control valve disposed near the second end controlling water flow from the conduit to the tub; and a sensor disposed downstream from the control valve and sensing water flow into the tub, wherein the appliance alternately opens and closes the valves each time the appliance is used.

16. The household appliance according to claim 15, further comprising a control device controlling operation of the stop valve and control valve and receiving signals from the sensor.

17. The household appliance according to claim 15, wherein the sensor includes a throughflow meter.

18. The household appliance according to claim 15, wherein the sensor includes a pressure sensor.

* * * * *